US011728089B2

(12) United States Patent
Lee et al.

(10) Patent No.: US 11,728,089 B2
(45) Date of Patent: Aug. 15, 2023

(54) COIL COMPONENT

(71) Applicant: SAMSUNG ELECTRO-MECHANICS CO., LTD., Suwon-si (KR)

(72) Inventors: Dong Jin Lee, Suwon-si (KR); Dong Hwan Lee, Suwon-si (KR); Chan Yoon, Suwon-si (KR); Sang Soo Park, Suwon-si (KR); Hye Mi Yoo, Suwon-si (KR); Hwi Dae Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 403 days.

(21) Appl. No.: 16/984,586

(22) Filed: Aug. 4, 2020

(65) Prior Publication Data

US 2021/0366649 A1 Nov. 25, 2021

(30) Foreign Application Priority Data

May 21, 2020 (KR) ..... 10-2020-0060743

(51) Int. Cl.

| | |
|---|---|
| ***H01F 27/29*** | (2006.01) |
| ***H01F 27/34*** | (2006.01) |
| ***H01F 27/28*** | (2006.01) |
| ***H01F 17/00*** | (2006.01) |

(Continued)

(52) U.S. Cl.

CPC ..... *H01F 27/292* (2013.01); *H01F 17/0013* (2013.01); *H01F 17/045* (2013.01);

(Continued)

(58) Field of Classification Search

CPC .. H01F 27/292; H01F 17/0013; H01F 17/045; H01F 27/255; H01F 27/2828; H01F 27/324; H01F 2017/048

See application file for complete search history.

(56) References Cited

U.S. PATENT DOCUMENTS 6,114,938 A * 9/2000 Iida ..... H01F 17/0006 336/200
6,137,237 A * 10/2000 MacLennan ..... H01J 61/523 313/231.71

(Continued)

FOREIGN PATENT DOCUMENTS

JP 2012-243902 A 12/2012
JP WO2018/092392 A1 5/2018

*Primary Examiner* — Mohamad A Musleh
*Assistant Examiner* — Malcolm Barnes
(74) *Attorney, Agent, or Firm* — Morgan, Lewis & Bockius LLP

(57) ABSTRACT

A coil component includes a body; a wound coil disposed in the body, and having a plurality of turns and first and second lead-out portions exposed to the surfaces of the body; a noise removing portion spaced apart from the wound coil, and including a pattern portion having a first end portion and a second end portion spaced apart from each other and forming an open loop, and a third lead-out portion connected to the pattern portion and exposed to one surface of the body; an insulating layer disposed between the wound coil and the noise removing portion; and first to third external electrodes disposed on the surfaces of the body, spaced apart from one another, and connected to the first to third lead-out portions, respectively, wherein one of the plurality of turns of the wound coil has a line width greater than a thickness thereof.

26 Claims, 10 Drawing Sheets

(51) Int. Cl.

| | |
|---|---|
| ***H01F 17/04*** | (2006.01) |
| ***H01F 27/25*** | (2006.01) |
| ***H01F 27/32*** | (2006.01) |
| ***H01F 27/255*** | (2006.01) |

(52) U.S. Cl.
CPC ..... *H01F 27/255* (2013.01); *H01F 27/2828* (2013.01); *H01F 27/324* (2013.01); *H01F 2017/048* (2013.01)

(56) References Cited

U.S. PATENT DOCUMENTS

| | | | | |
|---|---|---|---|---|
| 2002/0158306 | A1* | 10/2002 | Niitsu | H01L 28/10 257/E21.022 |
| 2004/0017280 | A1* | 1/2004 | Yamamoto | H01F 27/2804 336/84 R |
| 2004/0119573 | A1* | 6/2004 | Lee | H01F 19/04 336/200 |
| 2004/0145442 | A1* | 7/2004 | Matsutani | H01F 21/12 336/200 |
| 2009/0051474 | A1* | 2/2009 | Lee | H01F 17/04 336/83 |
| 2011/0215893 | A1* | 9/2011 | Nussbaum | H01F 19/02 336/200 |
| 2014/0022041 | A1* | 1/2014 | Park | H01F 5/00 336/199 |
| 2017/0032885 | A1* | 2/2017 | Lee | H01F 41/046 |
| 2017/0063322 | A1* | 3/2017 | Matsunaga | H01F 27/292 |
| 2017/0169933 | A1* | 6/2017 | Kim | H01F 17/04 |
| 2017/0372833 | A1* | 12/2017 | Jang | H01F 17/04 |
| 2019/0115143 | A1* | 4/2019 | Tachibana | H01F 27/292 |
| 2019/0269015 | A1 | 8/2019 | Nakazawa | |

* cited by examiner

II–II'

II–II'

I-I'

II-II'

II-II'

III-III'

IV-IV'

Ⅳ-Ⅳ'

Ⅲ-Ⅲ'

IV-IV'

IV-IV'

COIL COMPONENT

CROSS-REFERENCE TO RELATED APPLICATION(S)

The present application claims the benefit of priority to Korean Patent Application No. 10-2020-0060743 filed on May 21, 2020 in the Korean Intellectual Property Office, the disclosure of which is incorporated herein by reference in its entirety.

TECHNICAL FIELD

The present disclosure relates to a coil component.

BACKGROUND

An inductor, a type of coil component, is a representative passive electronic component used in electronic devices along with a resistor and a capacitor.

As electronic devices have been designed to have high performance and reduced sizes, an increased number of coil components have been used in electronic devices and sizes of coil components have been reduced.

For this reason, the demand for removing noise such as electromagnetic interference (EMI) in a wound coil component has increased.

SUMMARY

An aspect of the present disclosure is to provide a coil component which may easily remove noise.

According to an aspect of the present disclosure, a coil component may include a body having a first surface and a second surface opposing each other, a first end surface and a second end surface connecting the first surface to the second surface and opposing each other, and a first side surface and a second side surface connecting the first end surface to the second end surface and opposing each other; a wound coil disposed in the body, and having a plurality of turns having first and second lead-out portions exposed to the first end surface and the second end surface of the body; a noise removing portion disposed in the body and spaced apart from the wound coil, and including a pattern portion having first end portion and the second end portion spaced apart from each other and forming an open loop, and a third lead-out portion connected to the pattern portion and exposed to the first side surface of the body; an insulating layer disposed between the wound coil and the noise removing portion; and first to third external electrodes disposed on the first end surface, the second end surface, and the first side surface of the body, respectively, spaced apart from one another, and connected to the first to third lead-out portions, respectively, wherein one of the plurality of turns of the wound coil has a line width greater than a thickness thereof.

According to another aspect of the present disclosure, a coil component may include a body having a first surface and a second surface opposing each other, a first end surface and a second end surface connecting the first surface to the second surface and opposing each other, and a first side surface and a second side surface connecting the first end surface to the second end surface and opposing each other; an edge-wise type wound coil disposed in the body, and having a plurality of turns and first and second lead-out portions exposed to the first end surface and the second end surface of the body; and first and second noise removing portions disposed on opposing outermost turns of the wound coil, respectively, and spaced apart from the wound coil, wherein the first and second noise removing portions each include a pattern portion having a first end portion and a second end portion spaced apart from each other to form an open loop, and the first and second noise removing portions respectively include third and fourth lead-out portions connected to respective pattern portions and exposed to outer surfaces of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
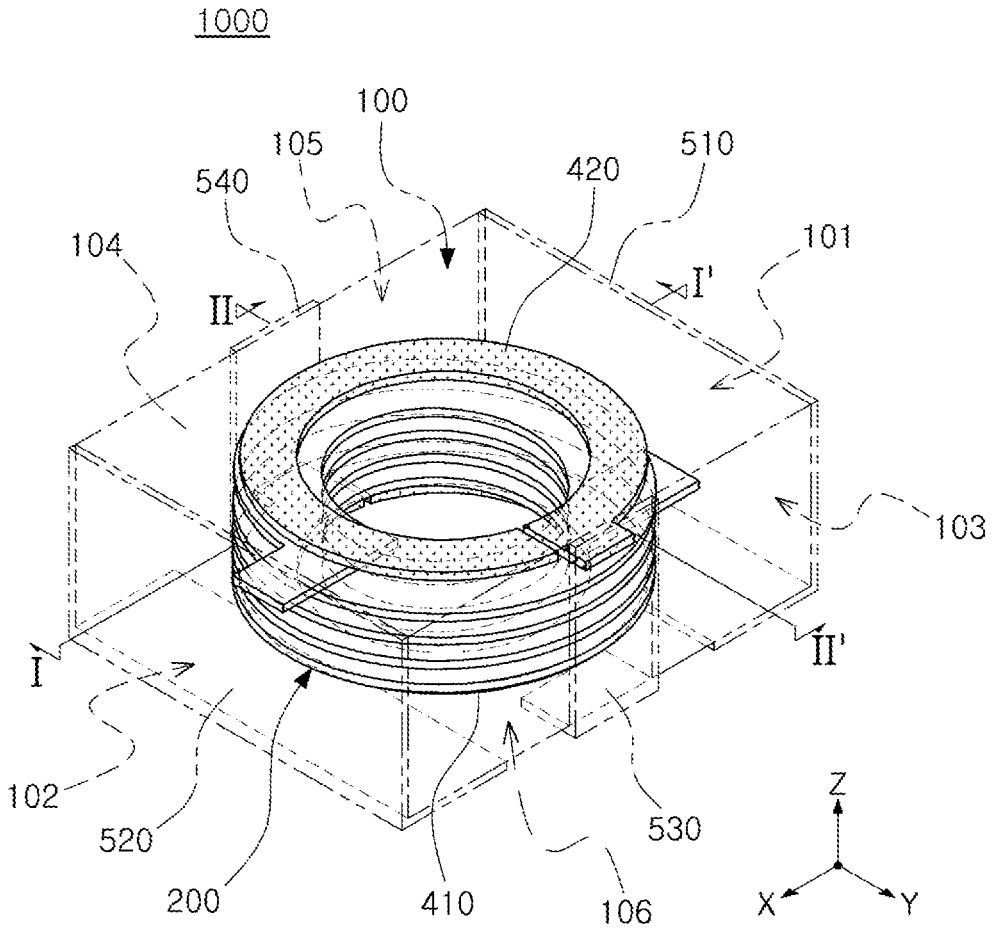
FIG. 1 is a schematic perspective diagram illustrating a coil component according to a first embodiment of the present disclosure.

Hereinafter, embodiments of the present disclosure will be described as follows with reference to the attached drawings.

The terms used in the following description are provided to explain a specific exemplary embodiment and are not intended to be limiting. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the terms "disposed on," "positioned on," "mounted on," and the like, may indicate that an element may be disposed on or below another element, and do not necessarily indicate that an element is only disposed in an upper portion with reference to a gravitational direction.

It will be understood that when an element is "coupled with/to" or "connected with" another element, the element may be directly coupled with/to another element, and there may be an intervening element between the element and another element.

Sizes and thicknesses of elements illustrated in the drawings are merely examples to help understanding of technical matters of the present disclosure.

In the drawings, an X direction is a first direction or a length direction, a Y direction is a second direction or a width direction, a Z direction is a third direction or a thickness direction.

In the drawings, same elements will be indicated by same reference numerals, and overlapping descriptions will not be provided.

In electronic devices, various types of electronic components may be used, and various types of coil components may be used between the electronic components to remove noise, and other purposes.

In an electronic device, a coil component may be used as a power inductor, an HF inductor, a general bead, a GHz bead, a common mode filter, and the like.

First Embodiment and Modified Examples Thereof

Figure 2:
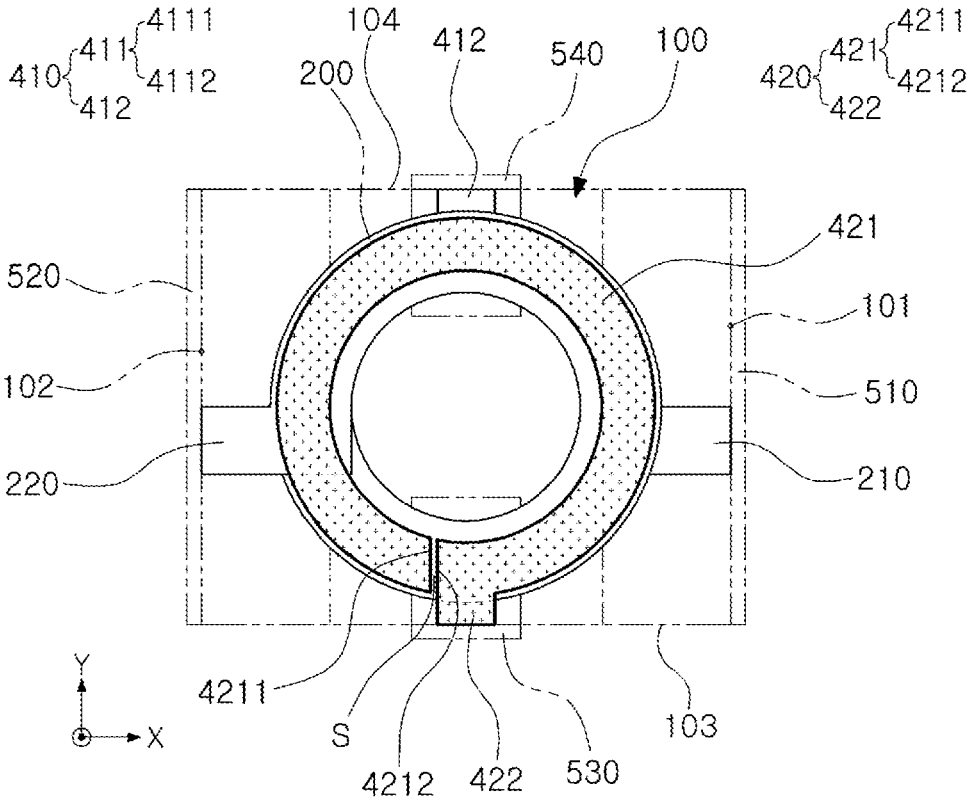
FIG. 2 is a schematic perspective diagram illustrating the coil component illustrated in FIG. 1, viewed from above.
Figure 3:
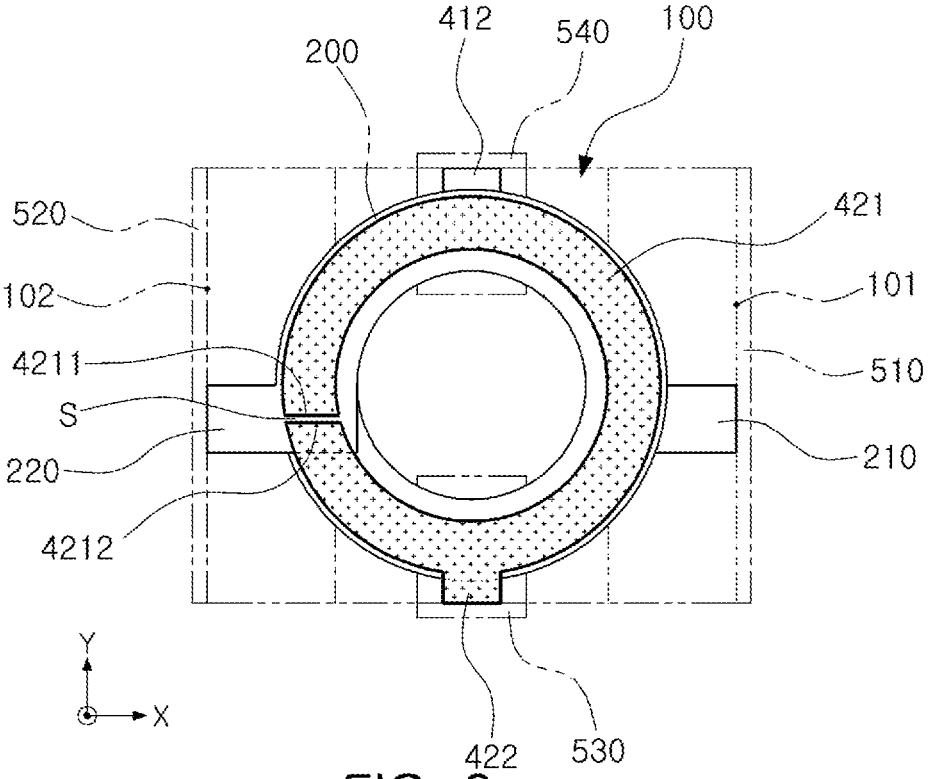
FIG. 3 is a schematic perspective diagram illustrating the coil component illustrated in FIG. 1, viewed from above, corresponding to FIG. 2.
Figure 4:
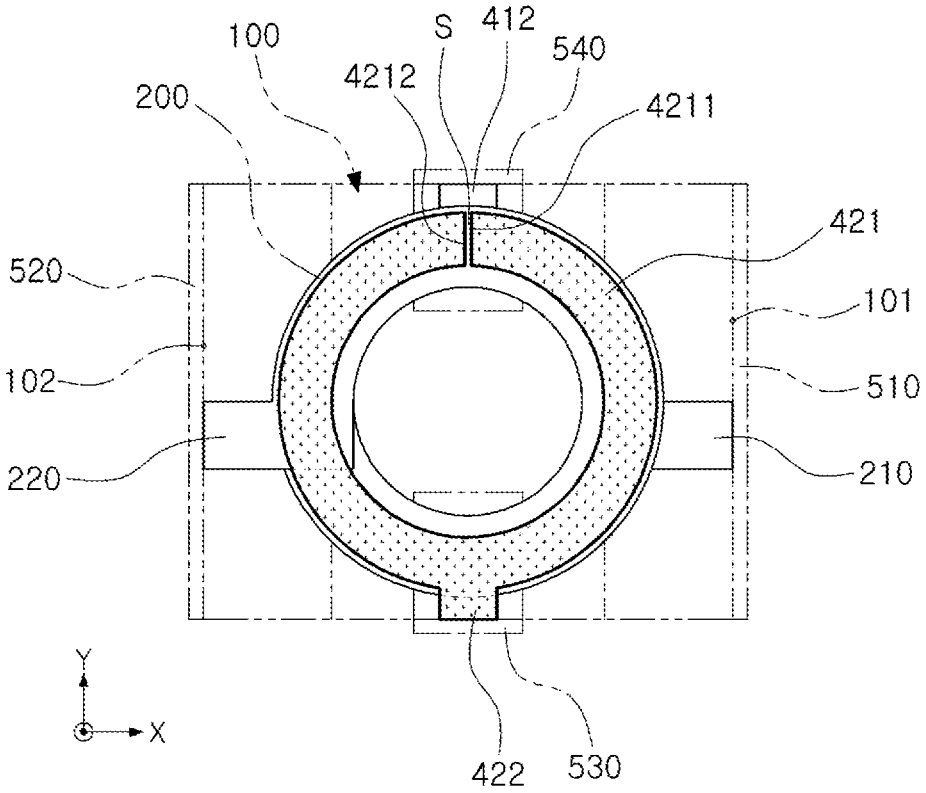
FIG. 4 is a schematic diagram the coil component illustrated in FIG. 1, viewed from above, corresponding to FIG. 2.
Figure 5:
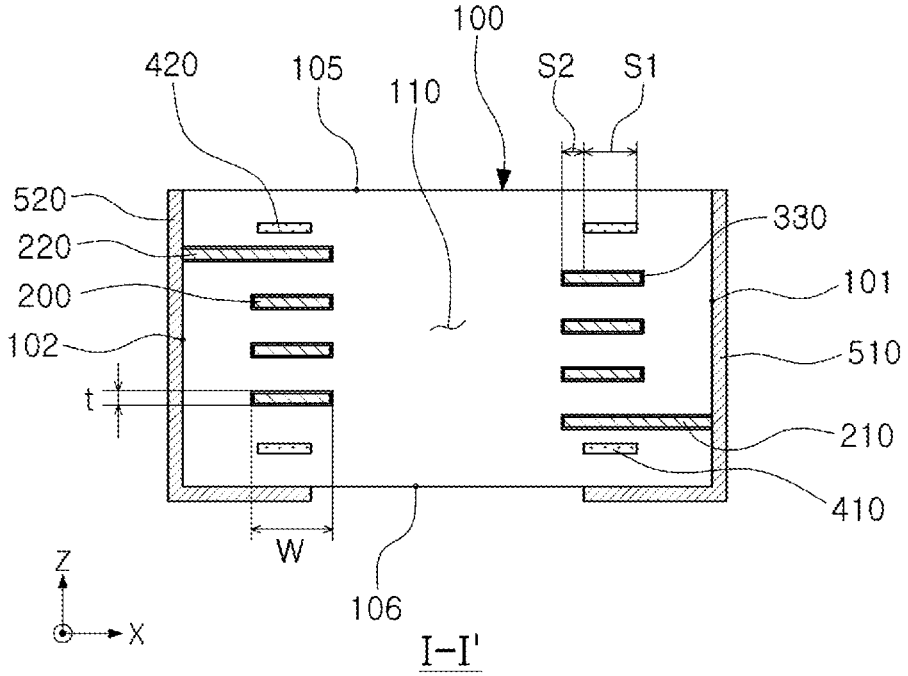
FIG. 5 is a cross-sectional diagram taken along line I-I' in FIG. 1.
Figure 6:
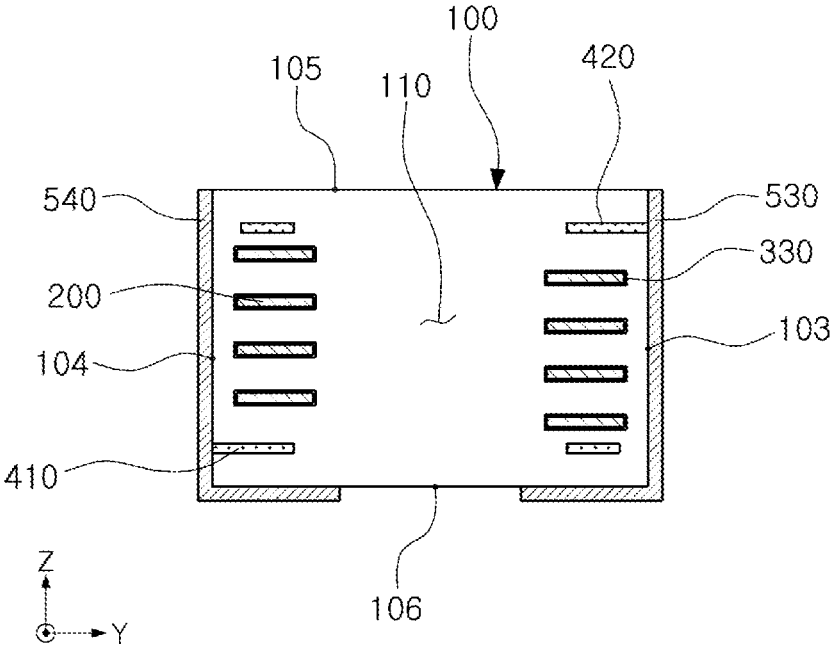
FIG. 6 is a cross-sectional diagram taken along line II-II' in FIG. 1.

FIG. 1 is a schematic perspective diagram illustrating a coil component according to a first embodiment. FIG. 2 is a schematic perspective diagram illustrating the coil component illustrated in FIG. 1, viewed from above. FIG. 3 is a schematic perspective diagram illustrating the coil component illustrated in FIG. 1, viewed from above, corresponding to FIG. 2. FIG. 4 is a schematic diagram the coil component illustrated in FIG. 1, viewed from above, corresponding to FIG. 2. FIG. 5 is a cross-sectional diagram taken along line I-I' in FIG. 1. FIG. 6 is a cross-sectional diagram taken along line II-II' in FIG. 1. FIG. 1 does not illustrate an insulating layer applied to this embodiment to clearly illustrate the coupling between the other elements.

Referring to FIGS. 1 to 6, a coil component 1000 of the first exemplary embodiment may include a body 100, a wound coil 200, an insulating layer 300, a noise removing portion 400, and first to fourth external electrodes 510, 520, 530, and 540, and may further include an insulating film 330.

The body 100 may form an exterior of the coil component 1000, and may include the wound coil 200 disposed therein.

The body 100 may have a hexahedral shape.

The body 100 may include a first surface 101 and a second surface 102 opposing each other in a length direction (X), a third surface 103 and a fourth surface 104 opposing each other in a width direction (Y), and a fifth surface 105 and a sixth surface 106 opposing each other in a thickness direction (Z). In the description below, both end surfaces of the body 100 may refer to the first surface 101 and the second surface 102, and both side surfaces of the body 100 may refer to the third surface 103 and the fourth surface 104. Also, one surface and the other surface of the body 100 may refer to the fifth surface 105 and the sixth surface 106 of the body 100.

The body 100 may be configured such that the coil component 1000 including the external electrodes 510, 520, 530, and 540 disposed therein may have a length of 2.0 mm, a width of 1.2 mm, and a thickness of 0.65 mm, but an exemplary embodiment thereof is not limited thereto. The above-mentioned sizes are merely sizes on a design which does not reflect a process error, and a range acknowledged as a process error may be included in the scope of the present disclosure.

The body 100 may include a magnetic material and resin. For example, the body 100 may be formed by layering one or more magnetic material sheets including resin and a magnetic material dispersed in the insulating resin. The body 100 may also have a structure different from the structure in which a magnetic material is disposed in resin. For example, the body 100 may be formed of a magnetic material such as ferrite.

The magnetic material may be ferrite powder or magnetic metal power.

The ferrite power may be one or more of spinel ferrite such as Mg—Zn based ferrite, Mn—Zn based ferrite, Mn—Mg based ferrite, Cu—Zn based ferrite, Mg—Mn—Sr based ferrite, Ni—Zn based ferrite, and the like, hexagonal ferrite such as Ba—Zn based ferrite, Ba—Mg based ferrite, Ba—Ni based ferrite, Ba—Co based ferrite, Ba—Ni—Co based ferrite, and the like, garnet ferrite such as Y based ferrite, and Li based ferrite, for example.

The magnetic metal power may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal power may be at least one or more of pure iron powder, Fe—Si based alloy power, Fe—Si—Al based alloy power, Fe—Ni based alloy power, Fe—Ni—Mo based alloy power, Fe—Ni—Mo—Cu based alloy power, Fe—Co based alloy power, Fe—Ni—Co based alloy power, Fe—Cr based alloy power, Fe—Cr—Si based alloy power, Fe—Si—Cu—Nb based alloy power, Fe—Ni—Cr based alloy power, and Fe—Cr—Al based alloy power.

The magnetic metal power may be amorphous or crystalline. For example, the magnetic metal power may be Fe—Si—B—Cr based amorphous alloy power, but an exemplary embodiment thereof is not limited thereto.

An average diameter of each of the ferrite power and the magnetic metal power may be 0.1 μm to 30 μm, but an exemplary embodiment thereof is not limited thereto.

The body 100 may include two or more different types of magnetic materials disposed in resin. The notion that different types of magnetic materials may be included indicates that the magnetic materials may be distinguished from each other by one of an average diameter, a composition, crystallinity, and a shape.

Resin may include one of epoxy resin, polyimide resin, silicone resin, silicone rubber, phenol resin, urea resin, melamine resin, polyvinyl alcohol (PVA), acrylic resin, liquid crystal crystalline polymer, and the like, or combinations thereof, but an exemplary embodiment thereof is not limited thereto.

For example, the body 100 may be formed by high-pressure compressing amorphous alloy power and resin using the above-mentioned resin as a binder. Generally, an edge-wise coil may refer to a coil wound to allow a plurality of turns are stacked with a short side of a rectangular wire as an inner diameter surface. When an edge-wise coil is used as in an exemplary embodiment, one of the plurality of turns of the wound coil 200 may have a line width W greater than a thickness t. Accordingly, direct current resistance (Rdc) may be reduced as compared to the example in which a line width of one of the plurality of turns is less than or the same as a thickness such that heat and copper loss occurring in compression may be prevented.

The wound coil 200 may be configured to be wound about a core 110, and may be disposed in the body 100 and may exhibit properties of a coil component. For example, when the coil component 1000 is used as a power inductor, the wound coil 200 may store an electrical field as a magnetic field and may maintain an output voltage, thereby stabilizing power of an electronic device.

The wound coil 200 may include a plurality of layers. Each of layers of the wound coil 200 may be configured to have a planar spiral shape, and may have a plurality of turns. The plurality of turns may include an outermost turn adjacent to the fifth surface 105 and the sixth surface 106 of the body 100, at least one central turn, and an innermost turn adjacent to a central portion of the body 100.

The wound coil 200 may be configured as a rectangular coil. The wound coil 200 may be formed by coiling a metal wire such as a copper wire in a spiral shape. As described below, the insulating layer 300 may be disposed on a surface of each of the plurality of turns of the wound coil 200.

The wound coil 200 may be connected to first and second lead-out portions 210 and 220 and may be connected to the first and second external electrodes 510 and 520. The first and second lead-out portions 210 and 220 may be exposed to the first surface 101 and the second surface 102 of the body 100, respectively, and may connect the wound coil 200 to the first and second external electrodes 510 and 520.

The insulating layer 300 may be disposed between the wound coil 200 and the noise removing portion 400. Referring to FIG. 5, the insulating layer 300 may include the insulating film 330 disposed along a surface of each of the plurality of turns of the wound coil 200 and disposed between an outermost turn of the wound coil 200 and the noise removing portion 400. Specifically, the insulating film 330 may be disposed between an outermost turn of the wound coil 200 adjacent to the sixth surface 106 of the body 100 and a first noise removing pattern 410, and may be disposed between an outermost turn adjacent to the fifth surface 105 of the body and a second noise removing pattern 420. The insulating film 330 may be disposed to protect and insulate a plurality of turns of the wound coil 200, and may include a generally used insulating material such as parylene. Any insulating material may be used as an insulating material included in the insulating film 330, and the insulating material included in the insulating film 330 is not limited to any particular material. The insulating film 330 may be formed by a method such as vapor deposition, or the like, but the method is not limited thereto. In this case, the insulating film 330 may function as a dielectric layer when the wound coil 200 is capacitive-coupled with the noise removing patterns 410 and 420 of the noise removing portion 400.

The noise removing portion 400 may be disposed in the body 100 to emit noise transferred to a component and/or noise generated in a component to amounting substrate, and the like. Specifically, the noise removing portion 400 may be buried in the body 100 and may be disposed on the wound coil 200, and may form an open-loop such that one end portion thereof may be exposed to a surface of the body 100.

Referring to FIGS. 2 to 6, the noise removing portion 400 may be disposed on each of outermost turns of the wound coil 200, and may include the first and second noise removing patterns 410 and 420 each forming an open-loop. Specifically, the first noise removing pattern 410 may include a first pattern portion 411 of which a first end portion 4111 and a second end portion 4112 may be spaced apart from each other and may form an open-loop, and a fourth lead-out portion 412 connected to the first pattern portion 411 and having one surface exposed to the fourth surface 104 of the body 100. The second noise removing pattern 420 may include a second pattern portion 421 of which a first end portion 4211 and a second end portion 4212 may be spaced apart from each other and may form an open-loop, and a third lead-out portion 422 connected to the second pattern portion 421 and having one surface exposed to the third surface 103 of the body 100. Accordingly, in an exemplary embodiment, a slit S may be formed between the first end portion 4111 and the second end portion 4112 of the first pattern portion 411 and between the first end portion 4211 and the second end portion 4212 of the second pattern portion 421. The slit S in an exemplary embodiment may refer to a spacing between the first end portions 4111 and 4211 and the second end portions 4112 and 4212 of the pattern portions 411 and 421, respectively. The slit S may refer to a three-dimensional space which may allow the first end portions 4111 and 4211 and the second end portions 4112 and 4212 of the pattern portions 411 and 421 to be physically spaced apart from each other such that the noise removing portion 400 may not form a closed-loop.

In an exemplary embodiment, the noise removing portion 400 may form a turn to correspond to a region in which the wound coil 200 is disposed. In an exemplary embodiment, each of the first and second pattern portions 411 and 421 may form a turn to correspond to the wound coil 200, and may have a ring shape in which the slit S is formed. Also, a line width of the noise removing portion 400 may be configured to be greater than a thickness of the noise removing portion 400. Accordingly, a line width of the first noise removing pattern 410 may be greater than a thickness of the first noise removing pattern 410, and a line width of the second noise removing pattern 420 may be greater than a thickness of the second noise removing pattern 420. Although not illustrated in detail, the noise removing portion 400 may be disposed on only one of outermost turns of the wound coil 200. When it is not necessary to remove noise, the noise removing portion 400 may be selectively formed on only one of the outermost turns of the wound coil 200 such that material costs may be reduced, and a ratio of a magnetic material in a component having the same size may relatively increase such that component properties may improve.

Referring to FIG. 4, a distance from the other end portion 4212 of the second pattern portion 421 to the third surface 103 of the body 100 may be the same as a distance from the one end portion 4211 of the second pattern portion 421 to the fourth surface 104 of the body 100. Referring to FIG. 3, a distance from the second end portion 4212 of the second pattern portion 421 to the third surface 103 of the body 100 may be smaller than a distance from the first end portion 4211 of the second pattern portion 421 to the fourth surface 104 of the body 100. Accordingly, the slit S may be disposed more adjacent to a side of the third surface 103 of the body 100 than a side of the fourth surface 104 of the body 100. In an exemplary embodiment, only the example of the second pattern portion 421 is described for ease of description, but the same descriptions may be applied to the first pattern portion 411.

Referring to FIGS. 2 to 5, a size of a region in which the noise removing portion 400 overlaps the outermost turn of the wound coil 200 in the thickness direction of the body 100 (e.g., Z direction) may be greater than a size of a region in which the noise removing portion 400 does not overlap the outermost turn of the wound coil 200. Referring to FIG. 5, a size S1 of a cross-sectional surface of a region in which the second noise removing pattern 420 overlaps the outermost turn of the wound coil 200 adjacent to the fifth surface 105 of the body 100 may be greater than a size S2 of a cross-sectional surface of a region in which the second noise removing pattern 420 does not overlap the outermost turn of the wound coil 200 adjacent to the fifth surface 105 of the body 100. In an exemplary embodiment, a deviation between a size of the region in which the noise removing portion 400 overlaps the outermost turn of the wound coil 200 and a size of the region in which the noise removing portion 400 does not overlap the outermost turn of the wound coil 200 may be 20% or less. When a deviation between a size of the overlapping region and a size of the non-overlapping region exceeds 20%, a function of removing noise aimed in the present disclosure may be deteriorated.

A general coil component which does not include a noise removing portion therein may easily pass a signal of a low frequency from a direct current, but a noise removing effect may rapidly degrade at a frequency higher than a self-resonant frequency (SRF). Differently from the example described above, in an exemplary embodiment in which the noise removing portion 400 is disposed adjacent to the wound coil 200, a signal of low frequency from a direct current may relatively easily pass through, whereas unnecessary noise having a high frequency may be effectively blocked as compared to a general coil component.

Referring to FIGS. 1 and 2, the third lead-out portion 422 may be exposed to the third surface 103 of the body 100. Specifically, the second noise removing pattern 420 may include the third lead-out portion 422 connected to the pattern portion 421 and exposed to the third surface 103 of the body 100. The first noise removing pattern 410 may include the fourth lead-out portion 412 connected to the pattern portion 411 and exposed to the fourth surface 104 of the body 100 to be spaced apart from the third lead-out portion 422. The third lead-out portion 422 may be in contact with and connected to the third external electrode 530 disposed on the third surface 103 of the body 100. In an exemplary embodiment, the fourth lead-out portion 412 may be exposed to the fourth surface 104 of the body 100 and may be connected to the fourth external electrode 540. The fourth external electrode 540 may be connected to a ground of a mounting substrate when the coil component 1000 of an exemplary embodiment is mounted on the mounting substrate, or when the coil component 1000 of an exemplary embodiment is packaged in an electronic component package, the fourth external electrode 540 may be connected to a ground of the electronic component package. Accordingly, in an exemplary embodiment, even when one of the third and fourth external electrodes 530 and 540 connected to a ground of a mounting substrate is disconnected from the mounting substrate, noise may be removed.

The noise removing patterns 410 and 420 may include a conductive material such as copper (Cu), aluminum (Al), silver (Ag), tin (Sn), gold (Au), nickel (Ni), lead (Pb), titanium (Ti), or alloys thereof, but an exemplary embodiment thereof is not limited thereto. The noise removing patterns 410 and 420 and the slit S may be formed by a method including at least one of an electroless plating method, an electrolytic plating method, a vapor deposition method such as a sputtering method, and an etching method, but the method is not limited thereto.

The first and second external electrodes 510 and 520 may be disposed on the first and second surfaces 101 and 102 of the body 100, respectively, and may be connected to the wound coil 200. Accordingly, referring to FIGS. 5 and 6, the first external electrode 510 may be in contact with and connected to the first lead-out portion 210 disposed on the first surface 101 of the body 100 and exposed to the first surface 101 of the body 100. The second external electrode 520 may be in contact with and connected to the second lead-out portion 220 disposed on the second surface 102 of the body 100 and exposed to the second surface 102 of the body 100. The first and second external electrodes 510 and 520 may be configured to extend from the first and second surfaces 101 and 102 of the body 100 to the sixth surface 106 of the body 100. The examples of the first and second external electrodes 510 and 520 illustrated in FIG. 1 and the other diagrams are merely examples, and each of the external electrodes 510 and 520 may also be configured to partially extend to each of the third, fourth, and fifth surfaces 103, 104, and 105 of the body 100 and may have a C-shaped form.

The first and second external electrodes 510 and 520 may electrically connect the coil component 1000 of an exemplary embodiment to a mounting substrate when the coil component 1000 is mounted on the mounting substrate such as a printed circuit board. As an example, the coil component 1000 in an exemplary embodiment may be mounted such that the sixth surface 106 of the body 100 may be directed to an upper surface of a printed circuit board, and the external electrodes 510 and 520 extending to the sixth surface 106 of the body 100 and a connection portion of the printed circuit board may be electrically connected to each other by a conductive coupling member such as solder.

The first to fourth external electrodes 510, 520, 530, and 540 may include at least one of a conductive resin layer and an electrolytic plating layer. The conductive resin layer may be formed by a paste printing process, or the like, and may include one or more conductive metals selected from a group consisting of copper (Cu), nickel (Ni), and silver (Ag), and a thermosetting resin. The electrolytic plating layer may include one or more selected from a group consisting of nickel (Ni), copper (Cu), and tin (Sn).

Figure 7:
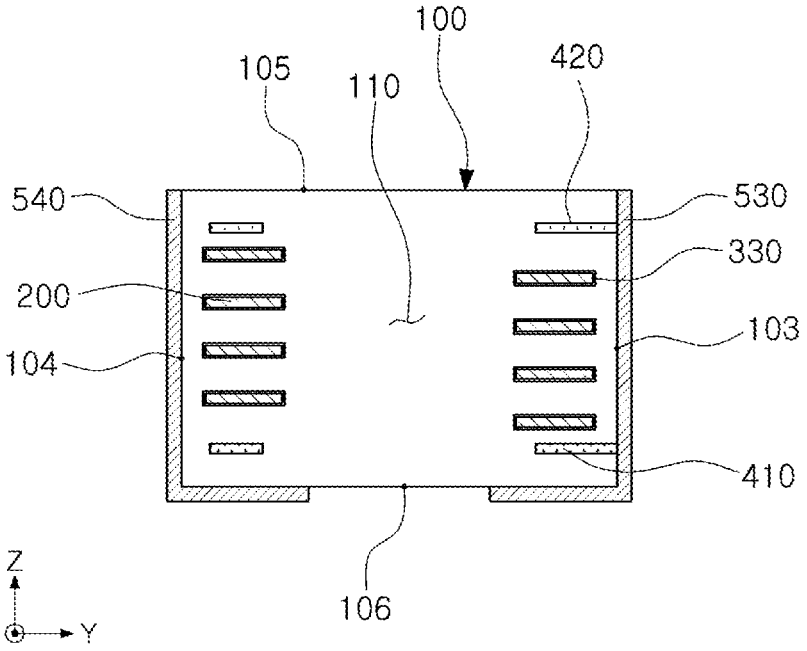
FIG. 7 is a schematic diagram illustrating a coil component according to a first modified example of the first embodiment, corresponding to the cross-sectional surface taken along line II-II' in FIG. 1.
Figure 8:
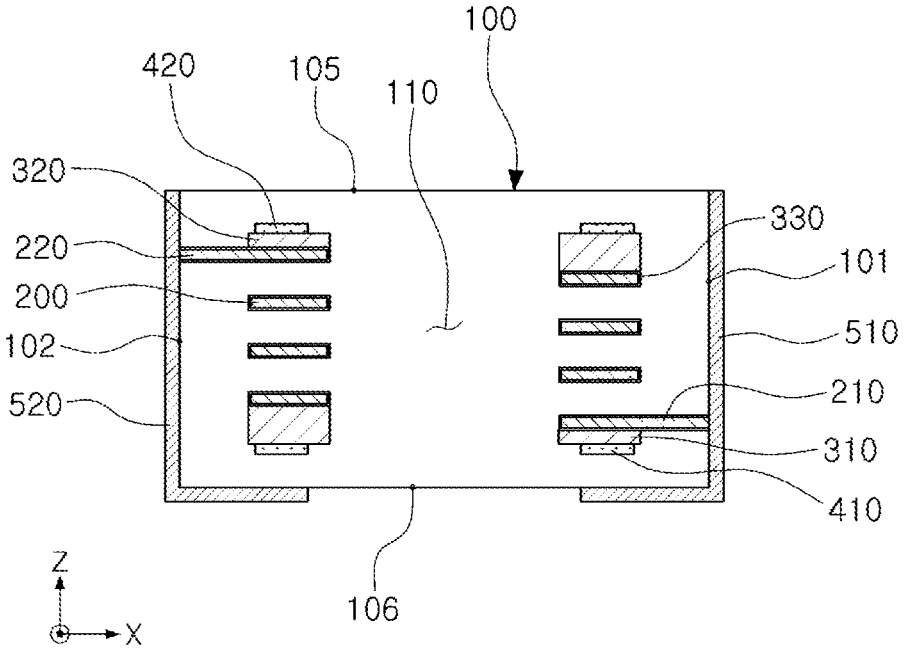
FIG. 8 is a schematic diagram illustrating a coil component according to a second modified example of the first embodiment, corresponding to the cross-sectional surface taken along line I-I' in FIG. 1.
Figure 9:
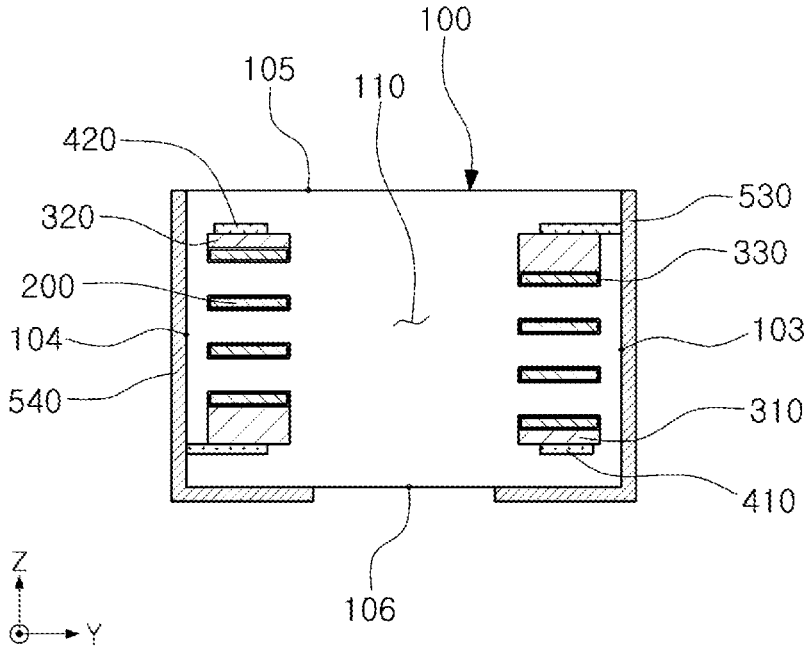
FIG. 9 is a schematic diagram illustrating a coil component according to a second modified example of the first embodiment, corresponding to the cross-sectional surface taken along line II-II' in FIG. 1.
Figure 10:
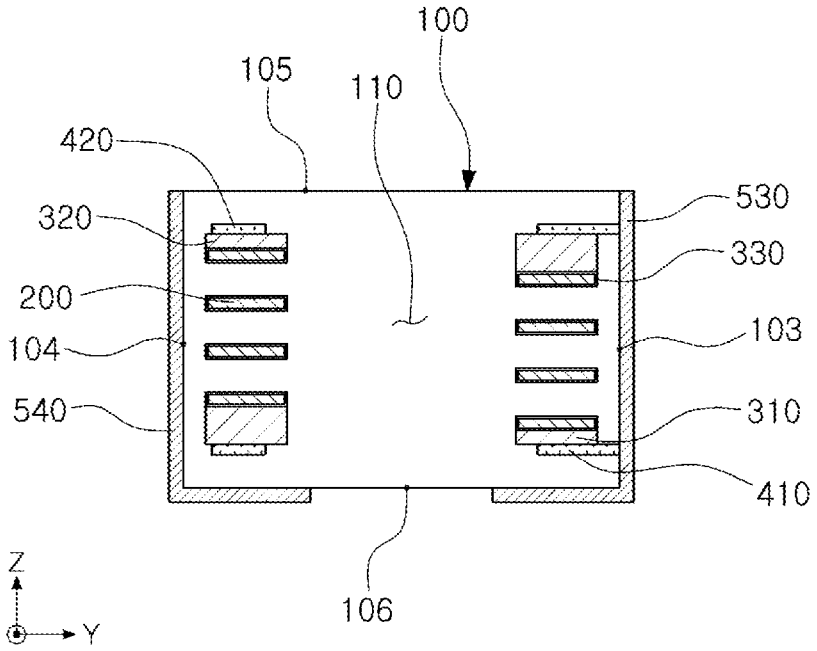
FIG. 10 is a schematic diagram illustrating a coil component according to a third modified example of the first embodiment.

FIG. 7 is a schematic diagram illustrating a coil component according to a first modified example of the first embodiment, corresponding to the cross-sectional surface taken along line II-II' in FIG. 1. FIG. 8 is a schematic diagram illustrating a coil component according to a second modified example of the first embodiment, corresponding to the cross-sectional surface taken along line I-I' in FIG. 1. FIG. 9 is a schematic diagram illustrating a coil component according to a second modified example of the first embodiment, corresponding to the cross-sectional surface taken along line II-II' in FIG. 1. FIG. 10 is a schematic diagram illustrating a coil component according to a third modified example of the first embodiment.

Referring to FIG. 7, in the first modified example of the first embodiment, a fourth lead-out portion 412 of a first noise removing pattern 410 may be exposed to the third surface 103 of the body 100, and a third lead-out portion 422 of a second noise removing pattern 420 may be exposed to the third surface 103 of the body 100. Also, the fourth lead-out portion 412 of the first noise removing pattern 410 may be in contact with and connected to a third external electrode 530 disposed on the third surface 103 of the body 100, and the third lead-out portion 422 of the second noise removing pattern 420 may be in contact with and connected to the third external electrode 530 disposed on the third surface 103 of the body 100. In the modified example, a fourth external electrode 540 disposed on the fourth surface 104 of the body 100 may be included, and the fourth external electrode 540 may be used as a non-contact terminal in the modified example and may be connected to a ground of a mounting substrate or may be connected to a ground of a package.

Referring to FIGS. 8 and 9, in the second modified example, an insulating layer 300 may further include additional insulating layers 310 and 320 disposed between an insulating film 330 and a noise removing portion 400. When the insulating film 330 is formed on a surface of a wound coil 200, as a plurality of turns of the wound coil 200 are formed in a spiral shape, a gap between the insulating film 330 and the noise removing portion 400 may not be constant. Accordingly, due to a deviation in thickness of a spacing between the insulating film 330 formed on an outermost turn of the wound coil 200 and the noise removing portion 400, a noise removing function may degrade. As in an exemplary embodiment, when the first additional insulating layer 310 is formed on an upper surface of an outermost turn adjacent to the sixth surface 106 of the body 100, and the second additional insulating layer 320 is formed on an upper surface of an outermost turn adjacent to the fifth surface 105 of the body 100, a noise removing function may be further intensified. The first and second additional insulating layers 310 and 320 may be formed by stacking an insulating film on each of outermost turns of the wound coil 200 on which the insulating film 330 is formed. The insulating film may be a general non-photosensitive insulating film such as an Ajinomoto build-up film (ABF), prepreg, or may be a photosensitive insulating film such as a dry-film or a PID. In this case, the first and second additional insulating layers 310 and 320 may work as dielectric layers when the wound coil 200 is capacitive-coupled to the noise removing patterns 410 and 420 of the noise removing portion 400, along with an insulating film 430.

Referring to FIG. 10, in the third modified example, a fourth lead-out portion 412 may be exposed to the third surface 103 of the body and may be connected to a third external electrode 530.

Second Embodiment and Modified Examples Thereof

Figure 11:
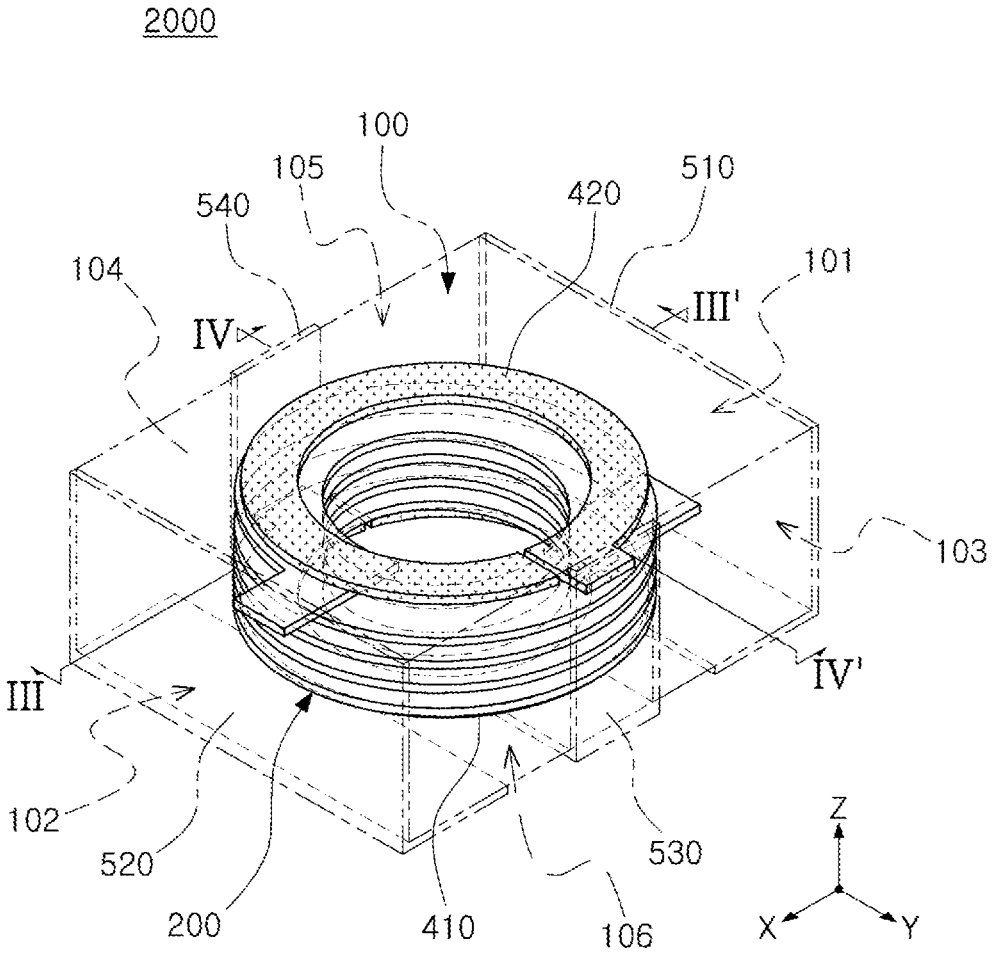
FIG. 11 is a schematic diagram illustrating a coil component according to a second embodiment.
Figure 12:
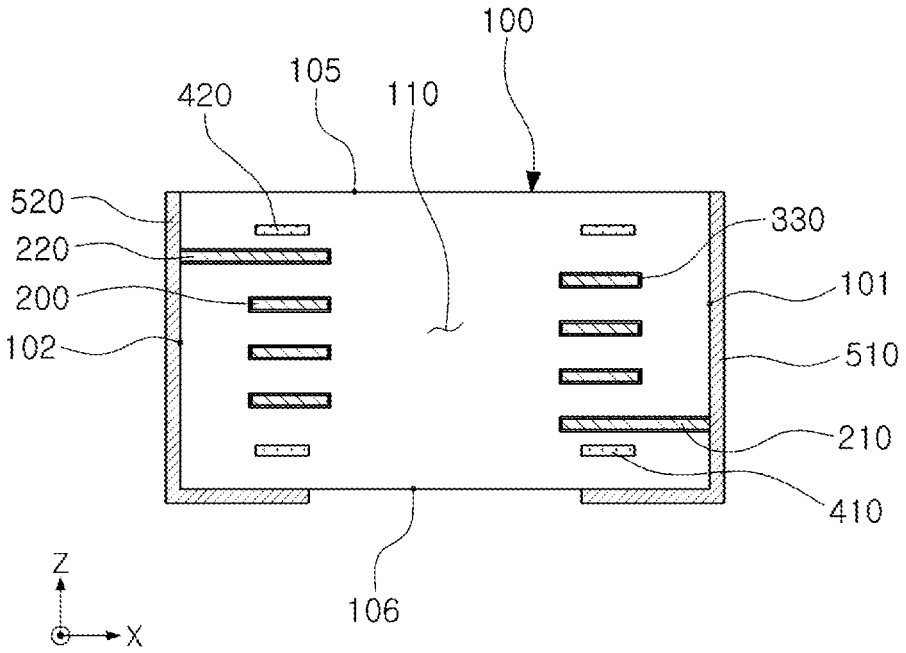
FIG. 12 is a cross-sectional diagram taken along line in FIG. 11.
Figure 13:
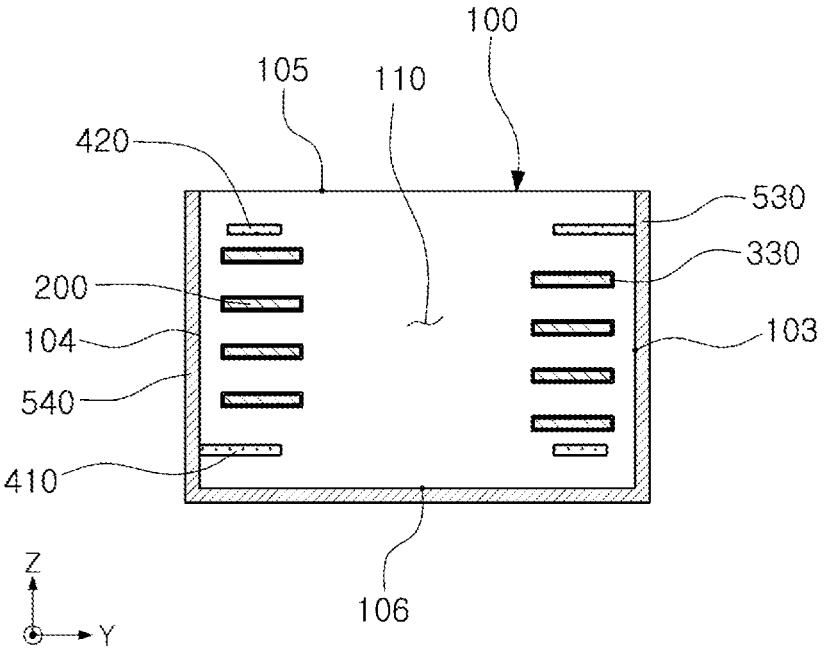
FIG. 13 is a cross-sectional diagram taken along line IV-IV' in FIG. 11.

FIG. 11 is a schematic diagram illustrating a coil component according to a second embodiment. FIG. 12 is a cross-sectional diagram taken along line in FIG. 11. FIG. 13 is a cross-sectional diagram taken along line IV-IV' in FIG. 11. FIG. 11 does not illustrate an insulating layer applied to the second embodiment to clearly illustrate the coupling between the other elements.

Referring to FIGS. 11 to 13, in a coil component 2000 in an exemplary embodiment, shapes of third and fourth external electrodes 530 and 540 may be different from those of the external electrodes of the coil component 1000 described in the first embodiment. Thus, in the description of this embodiment, only the shapes of the third and fourth external electrodes 530 and 540 different from those in the first embodiment will be described. The same descriptions in the first embodiment may be applied to the other elements of this embodiment.

Referring to FIGS. 11 to 13, the third and fourth external electrodes 530 and 540 in an exemplary embodiment may be connected to each other on the sixth surface 106 of the body 100.

Specifically, an end portion of the third external electrode 530 extending onto the sixth surface 106 of the body 100 may be in contact with and connected to an end portion of the fourth external electrode 540 extending onto the sixth surface 106 of the body 100. When the coil component 2000 is mounted on amounting substrate such as a printed circuit board, the sixth surface 106 of the body 100 may be amounting surface. A plurality of signal pads and a plurality of ground pads may be formed on a surface of the mounting substrate to be connected to components, and in an exemplary embodiment, as the third and fourth external electrodes 530 and 540 are configured to be connected to each other on the sixth surface 106 of the body 100, a ground pad of the mounting substrate and noise removing patterns 410 and 420 may be easily connected to each other. Accordingly, a mounting process may be easily performed.

Figure 14:
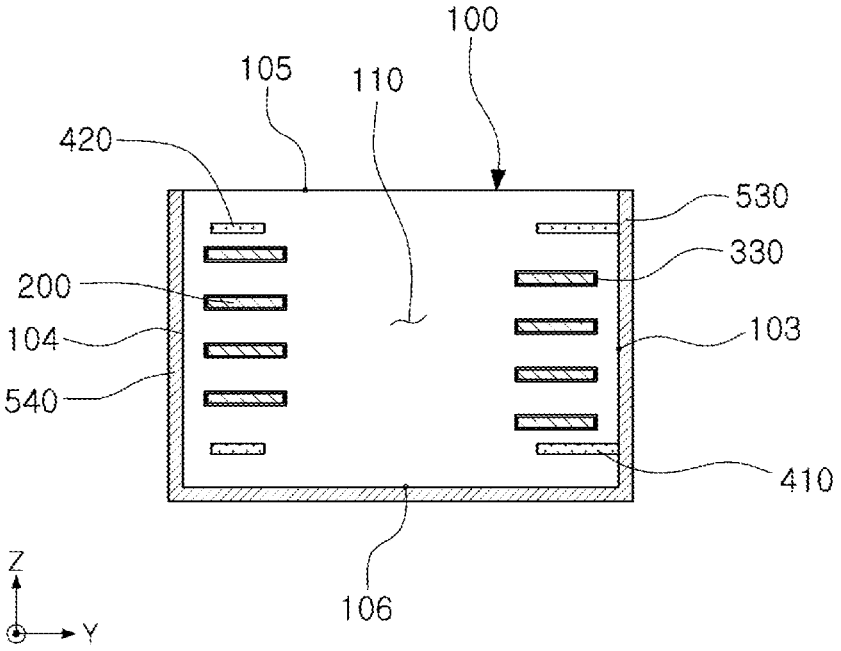
FIG. 14 is a schematic diagram illustrating a coil component according to a first modified example of the second embodiment, corresponding to the cross-sectional surface taken along line IV-IV' in FIG. 11.

FIG. 14 is a schematic diagram illustrating a coil component according to a first modified example of the second embodiment, corresponding to the cross-sectional surface taken along line IV-IV' in FIG. 11.

Referring to FIG. 14, third and fourth external electrodes 530 and 540 in the modified example may be configured to surround third, sixth, and fourth surfaces 103, 106, and 104 of the body 100. In the modified example, the third and fourth external electrodes 530 and 540 connected to the noise removing patterns 410 and 420 may be easily formed on a surface of the body 100. In other words, the third and fourth external electrodes 530 and 540 may be easily formed using a printing method such as a screen-printing method, or the like. Alternatively, even when the third and fourth external electrodes 530 and 540 are formed using a plating method, by patterning a plating resist relatively simply, the third and fourth external electrodes 530 and 540 may be easily formed.

Figure 15:
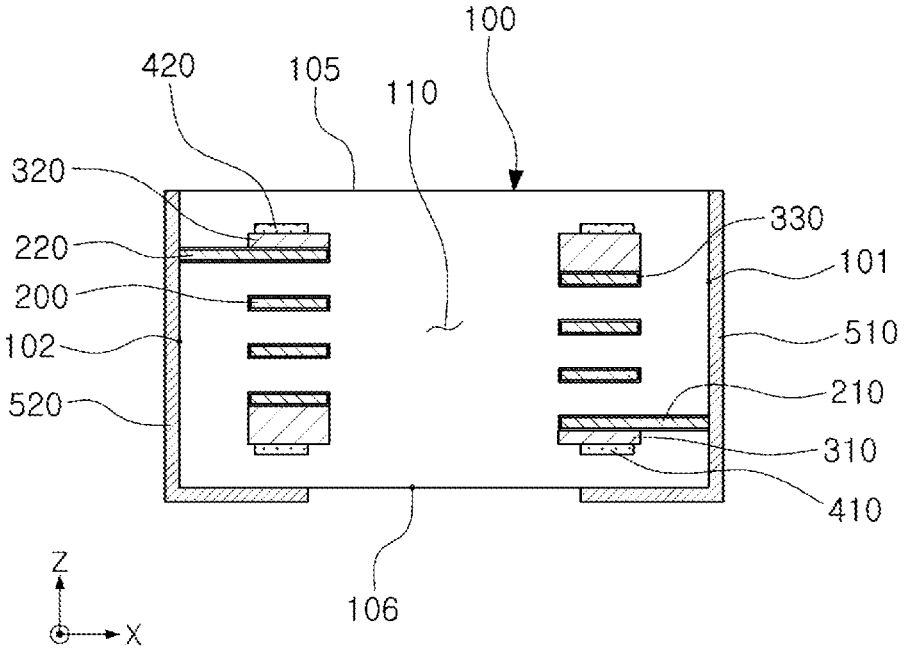
FIG. 15 is a schematic diagram illustrating a coil component according to a second modified example of the second embodiment, corresponding to the cross-sectional surface taken along line in FIG. 11.
Figure 16:
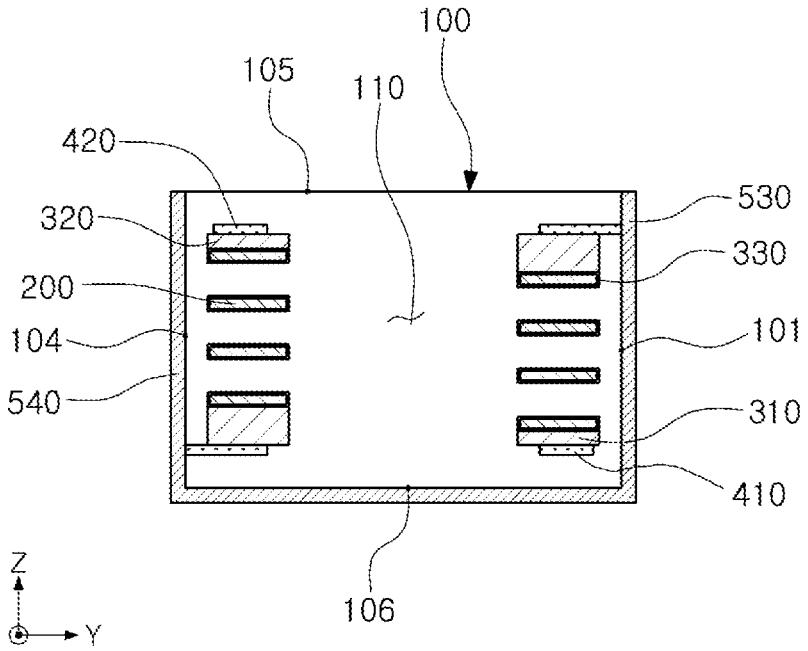
FIG. 16 is a schematic diagram illustrating a coil component according to a second modified example of the second embodiment, corresponding to the cross-sectional surface taken along line IV-IV' in FIG. 11.

FIG. 15 is a schematic diagram illustrating a coil component according to a second modified example of the second embodiment, corresponding to the cross-sectional surface taken along line in FIG. 11. FIG. 16 is a schematic diagram illustrating a coil component according to a second modified example of the second embodiment, corresponding to the cross-sectional surface taken along line IV-IV' in FIG. 11.

Referring to FIGS. 15 and 16, third and fourth external electrodes 530 and 540 in the modified example may be configured to surround third, sixth, fourth, and fifth surfaces 103, 106, 104, and 105 of the body 100. In the modified example, the third and fourth external electrodes 530 and 540 connected to the noise removing patterns 410 and 420 may be easily formed on a surface of the body 100. In other words, the third and fourth external electrodes 530 and 540 may be easily formed using a printing method such as a screen printing method, or the like. Alternatively, even when the third and fourth external electrodes 530 and 540 are formed using a plating method, by patterning a plating resist relatively simply, the third and fourth external electrodes 530 and 540 may be easily formed.

Figure 17:
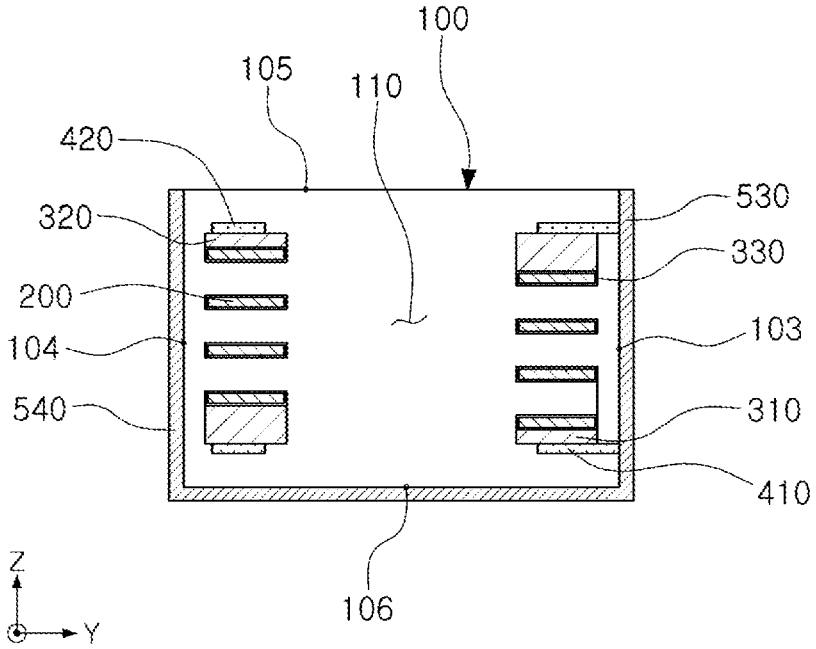
FIG. 17 is a schematic diagram illustrating a coil component according to a third modified example of the second embodiment, corresponding to the cross-sectional surface taken along line IV-IV' in FIG. 11.

FIG. 17 is a schematic diagram illustrating a coil component according to a third modified example of the second embodiment, corresponding to the cross-sectional surface taken along line IV-IV' in FIG. 11.

Referring to FIG. 17, third and fourth external electrodes 530 and 540 in the modified example may be configured to surround third, sixth, fourth, and fifth surfaces 103, 106, 104, and 105 of the body 100. In the modified example, the third and fourth external electrodes 530 and 540 connected to the noise removing patterns 410 and 420 may be easily formed on a surface of the body 100. In other words, the third and fourth external electrodes 530 and 540 may be easily formed using a printing method such as a screen printing method, or the like. Alternatively, even when the third and fourth external electrodes 530 and 540 are formed using a plating method, by patterning a plating resist relatively simply, the third and fourth external electrodes 530 and 540 may be easily formed.

Although not illustrated in the diagrams, the exemplary embodiment may also be modified similarly to the modified examples of the first embodiment.

According to the aforementioned exemplary embodiments, noise may be easily removed.

While the exemplary embodiments have been shown and described above, it will be apparent to those skilled in the art that modifications and variations could be made without departing from the scope of the present disclosure as defined by the appended claims.

What is claimed is:

1. A coil component, comprising:

a body having a first surface and a second surface opposing each other, a first end surface and a second end surface connecting the first surface to the second surface and opposing each other, and a first side surface and a second side surface connecting the first end surface to the second end surface and opposing each other;

a wound coil disposed in the body, and having a plurality of turns and first and second lead-out portions exposed to the first end surface and the second end surface of the body;

a noise removing portion disposed in the body and spaced apart from the wound coil, and including a pattern portion having a first end portion and a second end portion spaced apart from each other and forming an open loop, and a third lead-out portion connected to the pattern portion and exposed to the first side surface of the body such that the noise removing portion is spaced apart from the second side surface of the body;

an insulating layer disposed between the wound coil and the noise removing portion; and first to third external electrodes disposed on the first end surface, the second end surface, and the first side surface of the body, respectively, spaced apart from one another, and connected to the first to third lead-out portions, respectively, wherein one of the plurality of turns of the wound coil has a line width greater than a thickness thereof.

2. The coil component of claim 1, wherein a line width of the noise removing portion is greater than a thickness of the noise removing portion.

3. The coil component of claim 1, wherein the noise removing portion forms a turn to correspond to a region in which the wound coil is disposed.

4. The coil component of claim 1, wherein the noise removing portion includes a conductive material.

5. The coil component of claim 1, wherein a slit is defined between the first end portion and the second end portion of the pattern portion.

6. The coil component of claim 5, wherein the slit is disposed more adjacent to the first side surface of the body than the second side surface of the body.

7. The coil component of claim 5, wherein a distance from the first end portion of the pattern portion to the first end surface of the body is substantially the same as a distance from the second end portion of the pattern portion to the second end surface of the body.

8. The coil component of claim 5, wherein the slit is arranged on the noise removing portion such that the second end portion of the pattern portion shares a surface with the third lead-out portion.

9. The coil component of claim 1, wherein the plurality of turns of the wound coil include outermost turns adjacent to the first surface and the second surface of the body and an innermost turn adjacent to a central portion of the body, in a thickness direction of the body, and wherein the noise removing portion includes first and second noise removing patterns disposed on the outermost turns of the wound coil, respectively, and each forming an open-loop.

10. The coil component of claim 9, wherein a size of a region in which the noise removing portion overlaps the outermost turn of the wound coil is greater than a size of a region in which the noise removing portion does not overlap the outermost turn of the wound coil.

11. The coil component of claim 10, wherein a deviation between a size of a region in which the noise removing portion overlaps the outermost turn of the wound coil and a size of a region in which the noise removing portion does not overlap the outermost turn of the wound coil is 20% or less.

12. The coil component of claim 9, wherein the insulating layer includes an insulating film disposed along a surface of each of the plurality of turns of the wound coil and disposed between the outermost turn of the wound coil and the noise removing portion.

13. The coil component of claim 12, further comprising:

an additional insulating layer disposed between the insulating film and the noise removing portion.

14. The coil component of claim 9, wherein the second noise removing pattern includes the third lead-out portion connected to the pattern portion and exposed to the first side surface of the body, and wherein the first noise removing pattern includes a fourth lead-out portion connected to another pattern portion of the first noise removing pattern and spaced apart from the third lead-out portion.

15. The coil component of claim 14, further comprising:

a fourth external electrode disposed on the second side surface of the body and having a portion spaced apart from the first to third external electrodes, wherein the fourth lead-out portion is exposed to the first side surface of the body and is connected to the third external electrode.

16. The coil component of claim 15, wherein the third external electrode and the fourth external electrode are in contact with and connected to each other on the second surface of the body.

17. The coil component of claim 14, further comprising:

a fourth external electrode disposed on the second side surface of the body and spaced apart from the first to third external electrodes, wherein the third lead-out portion of the second noise removing pattern is connected to the third external electrode, and wherein the fourth lead-out portion of the first noise removing pattern is exposed to the second side surface of the body and is connected to the fourth external electrode.

18. The coil component of claim 17, wherein the third external electrode and the fourth external electrode are in contact with and connected to each other on the second surface of the body.

19. A coil component, comprising:

a body having a first surface and a second surface opposing each other, a first end surface and a second end surface connecting the first surface to the second surface and opposing each other, and a first side surface and a second side surface connecting the first end surface to the second end surface and opposing each other;

an edge-wise type wound coil disposed in the body, and having a plurality of turns and first and second lead-out portions exposed to the first end surface and the second end surface of the body; and first and second noise removing portions disposed on opposing outermost turns of the wound coil, respectively, and spaced apart from the wound coil, wherein the first and second noise removing portions each include a pattern portion having a first end portion and a second end portion spaced apart from each other to form an open loop, the first and second noise removing portions respectively include third and fourth lead-out portions connected to respective pattern portions and exposed to outer surfaces of the body, and at least one of the first or second noise removing portion has a line width narrower than a line width of the edge-wise type wound coil.

20. The coil component of claim 19, wherein each turn of the edgewise-type wound coil has a line width greater than a thickness thereof.

21. The coil component of claim 19, further comprising:

first, second, third, and fourth external electrodes disposed on the first end surface, the second end surface, the first side surface, and the second end surface of the body, respectively, and spaced apart from one another, wherein the first and second lead-out portions of the wound coil are connected to the first and second external electrodes, respectively.

22. The coil component of claim 21, wherein the third and fourth lead-out portions of the first and second noise removing portions are connected to the third and fourth external electrodes, respectively.

23. The coil component of claim 21, wherein both of the third and fourth lead-out portions of the first and second noise removing portions are connected to the third external electrode.

24. The coil component of claim 19, further comprising:

insulating layers disposed between the opposing outermost turns of the wound coil and the first and second noise removing portions, respectively.

25. The coil component of claim 19, wherein a line width of each of the first and second noise removing portions is greater than a thickness of each of the first and second noise removing portions.

26. The coil component of claim 19, wherein a slit is defined between the first end portion and the second end portion of each pattern portion of the first and second noise removing portions.

* * * * *